US008283601B2

(12) United States Patent
Jin

(10) Patent No.: US 8,283,601 B2
(45) Date of Patent: Oct. 9, 2012

(54) BONDING APPARATUS AND METHOD OF METAL PLATE

(75) Inventor: In Tai Jin, Busan (KR)

(73) Assignees: Sungwoo Hitech Co., Ltd., Pusan (KR); Pukyong National University Business Incubator Center, Busan (KR)

( * ) Notice: Subject to any disclaimer, the term of this patent is extended or adjusted under 35 U.S.C. 154(b) by 1305 days.

(21) Appl. No.: 11/994,541

(22) PCT Filed: Jul. 14, 2006

(86) PCT No.: PCT/KR2006/002780

§ 371 (c)(1),
(2), (4) Date: Jan. 3, 2008

(87) PCT Pub. No.: WO2007/008046

PCT Pub. Date: Jan. 18, 2007

(65) Prior Publication Data

US 2008/0197117 A1 Aug. 21, 2008

(30) Foreign Application Priority Data

Jul. 14, 2005 (KR) ..... 10-2005-0063503

(51) Int. Cl.

| | |
|---|---|
| ***B23K 11/00*** | (2006.01) |
| ***B23K 9/00*** | (2006.01) |
| ***B21J 5/08*** | (2006.01) |
| ***C21D 9/62*** | (2006.01) |

(52) U.S. Cl. ..... 219/148; 219/78.15; 219/127; 219/128; 219/150 V; 219/157

(58) Field of Classification Search ..... 219/148, 219/149, 150 R, 150 V, 153, 154, 157, 97, 219/98, 78.01, 78.15, 127, 128, 151; 29/432, 29/716, 798; 76/107.1; 228/44.3, 173.6
See application file for complete search history.

(56) References Cited

U.S. PATENT DOCUMENTS

| | | | | |
|---|---|---|---|---|
| 5,739,498 | A | 4/1998 | Sunamoto et al. | |
| 5,884,832 | A | 3/1999 | Funamoto et al. | |
| 6,684,479 | B2 * | 2/2004 | Wang et al. | 219/151 |
| 7,748,595 | B2 * | 7/2010 | Jin | 228/44.3 |

FOREIGN PATENT DOCUMENTS

| | | |
|---|---|---|
| DE | 10060390 | 6/2002 |
| DE | 102004003909 | 8/2005 |
| DE | 102004025492 | 8/2009 |
| JP | 56-59540 | 5/1981 |
| JP | 58-132382 | 8/1983 |
| JP | 62-101680 | 6/1987 |
| JP | 08-080572 | 3/1996 |
| JP | 2001-321967 | 3/2000 |

* cited by examiner

*Primary Examiner* — Henry Yuen
*Assistant Examiner* — Hung D Nguyen
(74) *Attorney, Agent, or Firm* — Lexyoume IP Meister, PLLC.

(57) ABSTRACT

A bonding apparatus of metal plates includes an upper mold having a first guide pathway formed vertically inside thereof; a middle mold having a second guide pathway formed vertically inside thereof, where the middle mold is disposed under the upper mold; a lower mold having a metal removing pathway formed vertically inside thereof, where the lower mold is disposed under the middle mold; a heating unit for heating the metal plates and a metal tape; a punch for applying a bonding load to the metal plates; a clamping unit that applies a clamping load for clamping the metal plates to the upper mold; and a bonding unit that applies the bonding load to the punch for bonding the metal plates.

24 Claims, 12 Drawing Sheets

BONDING APPARATUS AND METHOD OF METAL PLATE

BACKGROUND OF THE INVENTION (a) Field of the Invention

The present invention relates to bonding apparatus and method of metal plates. More particularly, the present invention relates to bonding apparatus and method of metal plates where a bonding process is simplified and bonding strength is improved.

(b) Description of the Related Art

Generally, two methods for bonding thin metal plates are known. The first method is spot welding, and the second method is rivet bonding. In spot welding, an electrical voltage is applied to overlapped metal plates, and heat is generated therein since the metal plates have electrical resistance. In this case, if a pressure is applied to the overlapped metal plates, overlapped surfaces of the metal plates are melted and the metal plates are bonded.

In rivet bonding, two metal plates are bored and bonded with a rivet.

The two methods each have merits. However, arcing and environmental pollution may occur since a high voltage is applied to the metal plates in spot welding. In addition, the resulting bonded surface may not be even.

Rivet bonding has advantages in that bonding strength is high and the bonding process is performed at room temperature. However, if one rivet is used for bonding metal plates, normal bonding force and shearing bonding force between the metal plates may be strong but the metal plates may rotate with respect to each other. Accordingly, multiple rivets must be used so that the metal plates do not rotate. In addition, manufacture of a rivet head must be done first, and holes of the metal plates must be aligned so that the rivet is inserted therein.

Recently, a self-piercing rivet bonding method has been developed in order to make up for such drawbacks of the rivet bonding method. In the self-piercing rivet bonding method, holes are bored in the metal plates and simultaneously molten pools are formed in the metal plates by frictional heat between the metal plates and the rivet, which bonds the metal plates.

However, in the self-piercing rivet bonding method, manufacture of a self-piercing rivet must be done first, and the self-piercing rivet must be rotated in order to bond the metal plates by the frictional heat.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a bonding apparatus and method of metal plates having advantages that an electrical arc does not occur and that a self-piercing rivet does not need to be rotated and manufactured.

According to the present invention, a press-fitting process of a self-piercing rivet method is united with a spot welding method where metal plates are quickly heated by applying a high electrical voltage thereto. Therefore, a heating process of metal plates by applying a high electrical voltage thereto and a press-fitting process where a rivet member made with the same material as the metal plates is press-fitted into the metal plates are simultaneously performed. Therefore, the rivet member and the metal plates are bonded in a plastic flow state.

That is, the metal plates and a metal tape are heated to the hot plastic working temperature where an electrical arc does not occur. After that, a rivet member is made by punching the metal tape and simultaneously the rivet member is pressure fitted into the metal plates.

An exemplary bonding apparatus of metal plates according to an embodiment of the present invention may include: metal plates that are overlapped with each other; a metal tape used for bonding the overlapped metal plates, a material thereof being the same as a material of the metal plates; a metal tape transfer unit for supplying and withdrawing the metal tape; a rivet member punched from the metal tape and heated; an upper mold for clamping the metal tape by an elastic force of a coil spring that is mounted on an upper portion thereof, the upper mold guiding a punch and being used as a first electrode; a middle mold for clamping the overlapped metal plates and punching the metal tape in order to make the rivet member, the middle mold guiding the rivet member and the punch, and being used as a second electrode; a lower mold for supporting the overlapped metal plates, the lower mold being used as an extrusion die for extruding the metal plates by the rivet member, and including a shaving mold for shaving excess metal during extrusion and a third electrode; and the punch for making the rivet member by punching the metal tape, the punch press-fitting the rivet member to the overlapped metal plates by applying a load to the rivet member.

Cross-sections of the first and second guide pathways and the metal removing pathway may be circular or triangular, by which a rotation of the metal plates is restricted, according to the cross-sectional shape of the rivet member.

At least one of the first and second guide pathways, the metal removing pathway, and the punch may be used so as to restrict the rotation of the metal plates.

In addition, the exemplary bonding apparatus of the metal plates according to the embodiment of the present invention may further include a robot provided with a power supply for supplying power to the first, second, and third electrodes and a hydraulic pressure system for supplying a clamping load, an extruding load, and a shaving load, wherein the robot is moved automatically to the bonding position of the metal plates.

An exemplary bonding apparatus of metal plates according to another exemplary embodiment of the present invention, may include: an upper mold having a first guide pathway formed vertically inside thereof; a middle mold having a second guide pathway formed vertically inside thereof, the middle mold being disposed under the upper mold; a lower mold having a metal-removing pathway formed vertically inside thereof, the lower mold being disposed under the middle mold; a heating unit for heating the metal plates and a metal tape; a punch for applying a bonding load to the metal plates; a clamping unit that applies a clamping load for clamping the metal plates to the upper mold; and a bonding unit that applies the bonding load for bonding the metal plates to the punch.

Both the upper and middle molds may clamp the metal tape, which is used for a rivet member, and both the middle and lower molds may clamp the metal plates.

Material of the metal tape may be the same as material of the metal plates.

The exemplary bonding apparatus of the metal plates according to another embodiment of the present invention may further include a lower mold transfer unit that moves the lower mold in a horizontal direction.

The exemplary bonding apparatus of the metal plates according to another embodiment of the present invention may further include a metal tape transfer unit that moves the metal tape in the horizontal direction.

The metal tape transfer unit may include: transfer rollers disposed on both sides of the upper mold; a metal tape supply roller disposed on one side of the clamping unit, the metal tape being wound thereon; and a metal tape withdrawal roller disposed on the other side of the clamping unit, the metal tape being withdrawn thereto after being punched.

The exemplary bonding apparatus of the metal plates according to another embodiment of the present invention may further include a clamping mold for clamping the metal tape, wherein the clamping mold is disposed on an interior circumference of the upper mold.

An elastic member, which applies an elastic force downwardly to the clamping mold, may be interposed between the upper mold and the clamping mold.

The elastic member may be a coil spring.

The heating unit may include: a first electrode formed on an interior circumference of the clamping mold; a second electrode formed on an interior circumference of the middle mold; and a third electrode formed on an interior circumference of the lower mold.

Heat may be generated in the metal plates and the metal tape when an electrical current is applied thereto, since electrical resistance thereof is high.

The first, second, and third electrodes may be respectively wound by a high frequency inducing coil.

In addition, another heating unit may include: a first laser source for heating the metal tape, the first laser source mounted on a lower side of the punch; and a second laser source for heating the metal plates, the second laser source mounted on an interior circumference of the lower mold.

The first and second guide pathways may have the same radius.

The radius of the metal removing pathway may be smaller than the radius of the second guide pathway.

The first and second guide pathways and the metal removing pathway may have cylindrical shapes.

In addition, the first and second guide pathways and the metal removing pathway may have triangular-prism shapes.

A bonding unit cylinder of the bonding unit may be formed at a clamping unit piston of the clamping unit.

An exemplary bonding method of metal plates according to an embodiment of the present invention may include: disposing a lower mold under a bonding position of overlapped metal plates in order to bond the overlapped metal plates; meeting the central axis of a second guide pathway to the center of the bonding position; simultaneously clamping the overlapped metal plates by a middle mold and a metal tape by a coil spring; quickly heating the metal tape that is clamped by the coil spring by applying an electrical current between a first electrode and a second electrode; making a heated rivet member by punching the clamped metal tape with a punch that is inserted in a first guide pathway; quickly heating the overlapped metal plates by applying an electrical current between the second electrode contacted to an upper side of the overlapped metal plates and a third electrode contacted to a lower side of the overlapped metal plates; press-fitting the heated rivet member into the metal plates that are clamped between the middle mold and the lower mold by a compression load of the punch; and bonding the overlapped metal plates with the rivet member by an extruding pressure and a shearing force when the heated rivet member and the heated overlapped metal plates in a state of plastic flow are extruded through a metal removing pathway, a radius of which is smaller than a radius of the second guide pathway.

The metal tape may be quickly heated by applying the electrical current between the second electrode connected to a power supply and the first electrode, the metal plates may be quickly heated by applying the electrical current between the second electrode and the third electrode connected to the power supply, the first, second, and third electrodes may have a cylindrical shape of the same central axis, the metal tape may be punched in the first guide pathway, the punched rivet member may be passed through the second guide pathway and is press-fitted into the heated portion of the metal plates, the metal plates may be extruded and bonded through plastic flow, and simultaneously excess metal may be pushed to the metal removing pathway when the punch is moved through the first and second guide pathways.

A high frequency inducing coil may be wound onto the first and second electrodes, the metal tape disposed between an upper mold and the middle mold may be quickly heated by an induced current of the high frequency inducing coil, a high frequency inducing coil may be wound onto the second and third electrodes, and the metal plates disposed between the middle mold and the lower mold may be quickly heated by an induced current of the high frequency inducing coil.

The metal tape disposed between the upper mold and the middle mold may be quickly heated by a first laser source mounted on a lower side of the punch, and the metal plates disposed between the middle mold and the lower mold may be quickly heated by a second laser source mounted on the metal removing pathway.

The punched metal tape may be withdrawn and wound onto a metal tape withdrawal roller by a metal tape transfer unit when the punch returns after the metal tape wound onto a metal tape supply roller is unwound and punched so that the metal tape is continuously supplied and withdrawn, and the metal tape supply roller may be replaced when the metal tape is consumed.

A lower side of the punch may be moved to an upper side of the overlapped metal plates so that protruding metal is not made when the rivet member is press-fitted into the metal plates, and the lower mold connected to a lower mold transfer unit may slide in a horizontal direction and shave the excess metal adhered to a lower side of the overlapped metal plates.

The heated metal plates in plastic flow may be bonded by a repetitive compressive load of the rivet member when the heated rivet member is press-fitted into the metal plates clamped between the middle mold and the lower mold after the rivet member is made by the punch.

An exemplary bonding method of metal plates according to another embodiment of the present invention may include: clamping the overlapped metal plates with a lower mold and a middle mold; disposing a metal tape over the overlapped metal plates by the middle mold and a upper mold; heating the overlapped metal plates and the metal tape with a heating unit; making a rivet member by punching the metal tape; and press-fitting the rivet member into the overlapped metal plates with a punch.

In addition, the exemplary bonding method of the metal plates according to another embodiment of the present invention may further include removing excess metal that is pushed out during press-fitting.

The excess metal may be removed and the metal plates may be shaved by moving the lower mold in a horizontal direction, coincidentally.

A first guide pathway may be formed vertically in the upper mold, a second guide pathway may be formed vertically in the middle mold, and a metal removing pathway may be formed vertically in the lower mold.

The first and second guide pathways may have the same radius.

The radius of the metal removing pathway may be smaller than the radius of the second guide pathway.

Figure 1:
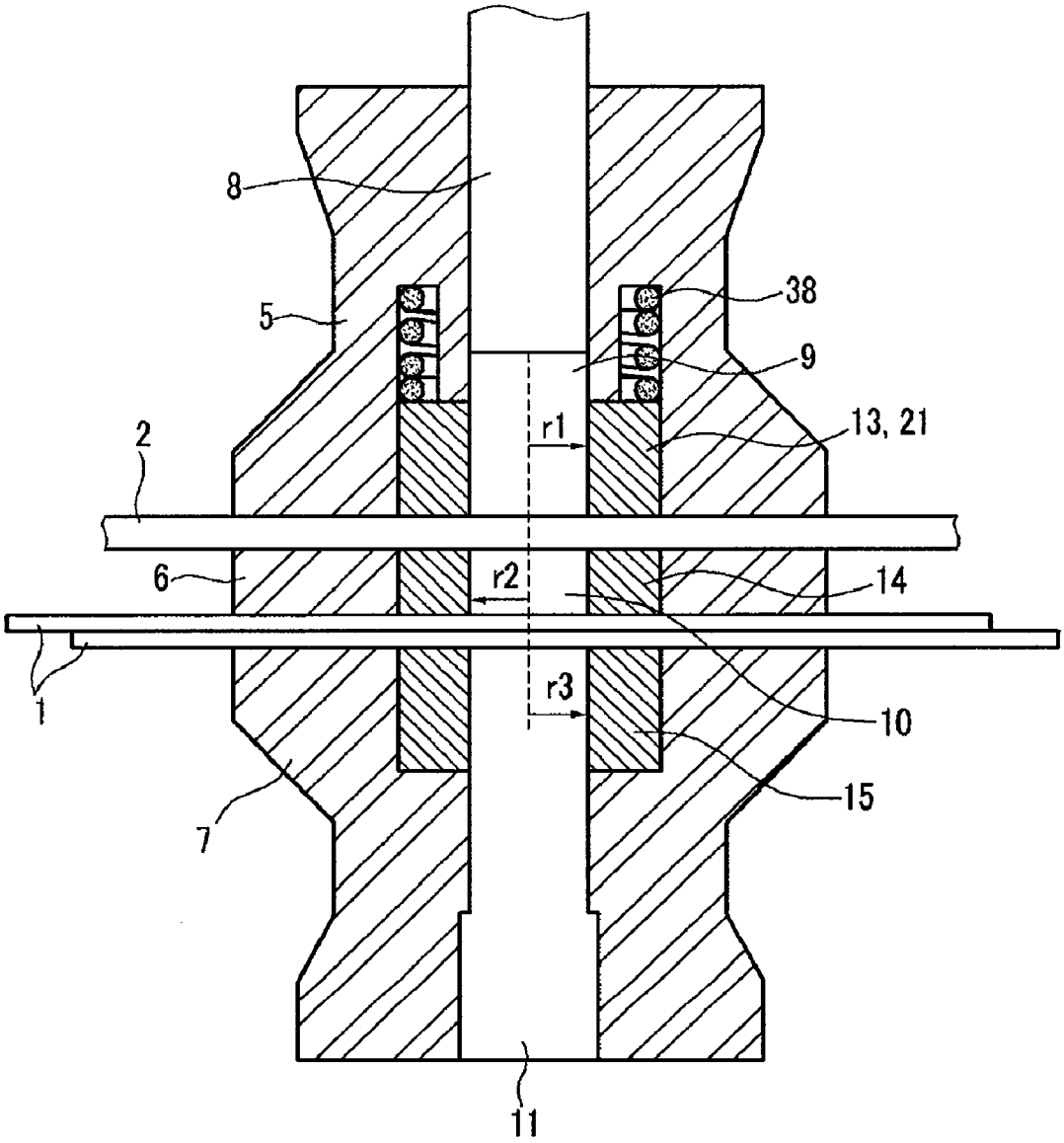
FIG. 1 is a cross-sectional view of a part of an exemplary bonding apparatus of metal plates according to an embodiment of the present invention.
Figure 2A:
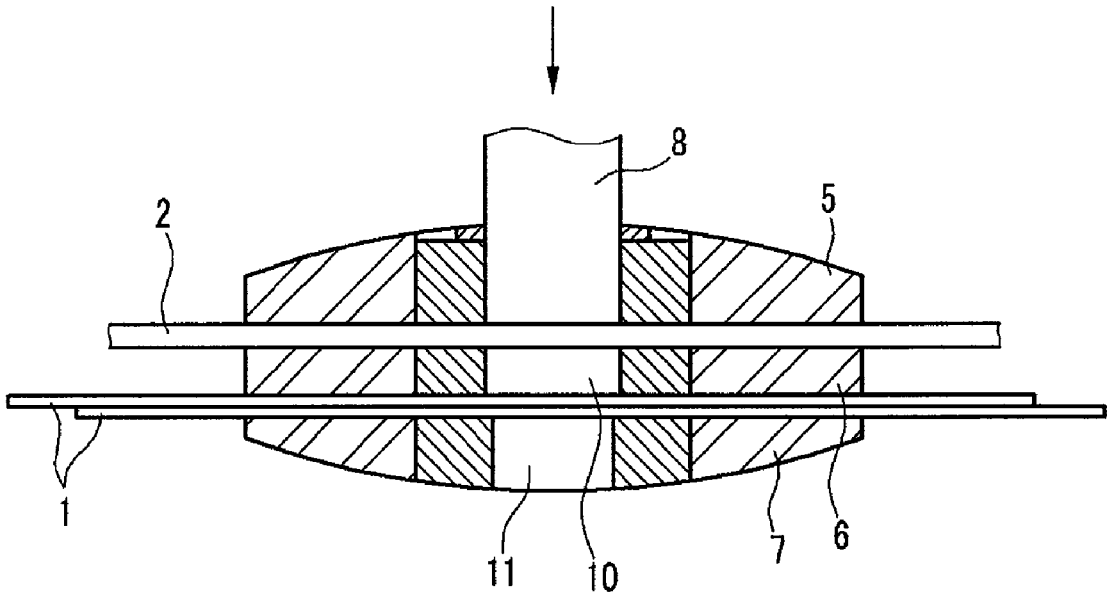
FIG. 2A is a cross-sectional view that shows a process in which a metal tape is punched according to an exemplary bonding apparatus of a metal plate according to an embodiment of the present invention.
Figure 2B:
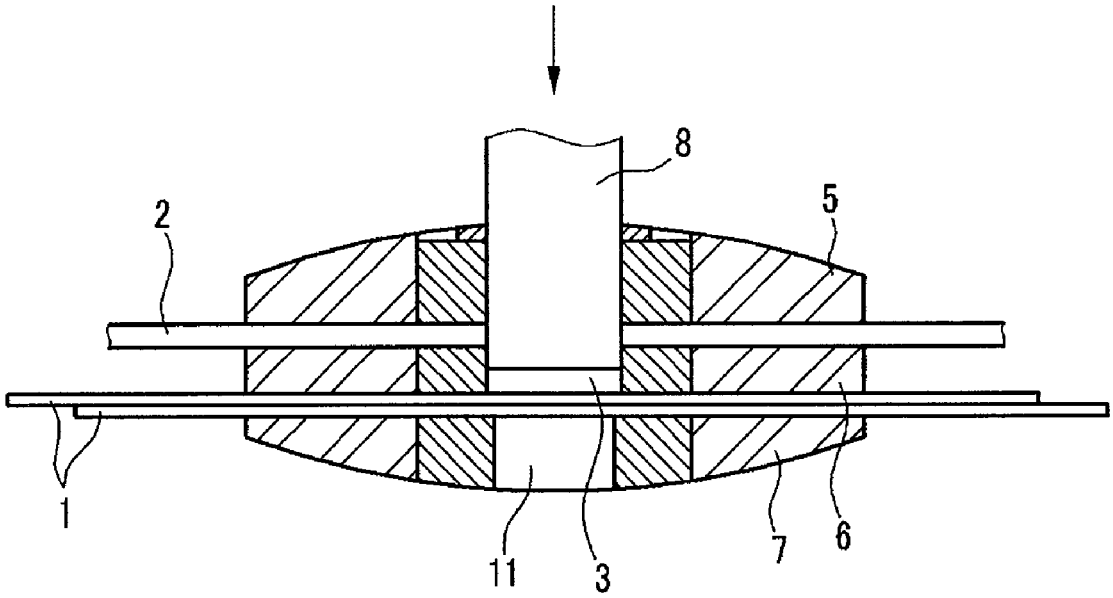
FIG. 2B is a cross-sectional view that shows a process in which a rivet member is press-fitted into metal plates according to an exemplary embodiment of the present invention.
Figure 2C:
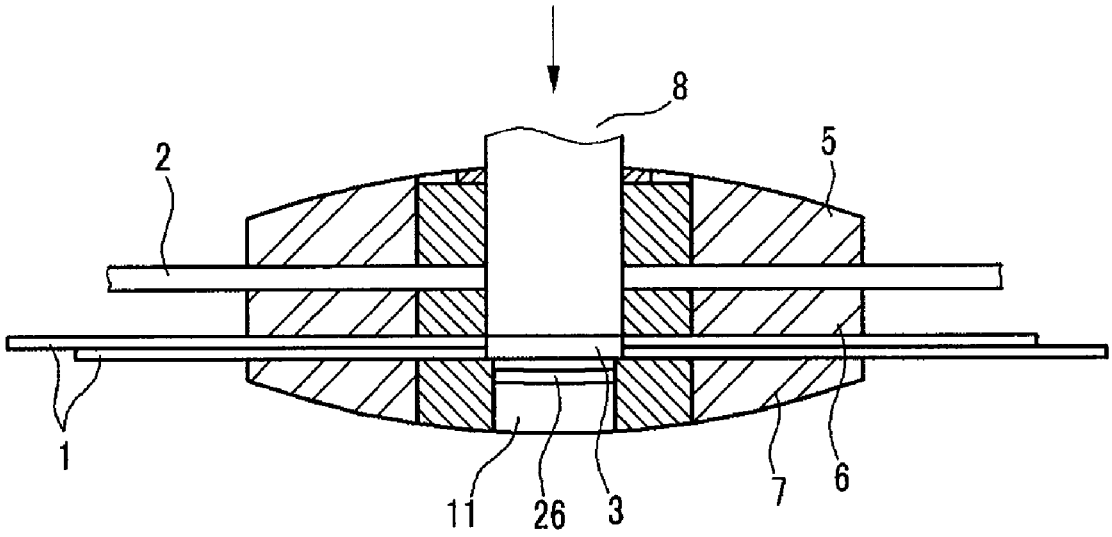
FIG. 2C is a cross-sectional view that shows a process in which excess metal is pushed out when a rivet member is press-fitted into metal plates according to an exemplary embodiment of the present invention.
Figure 2D:
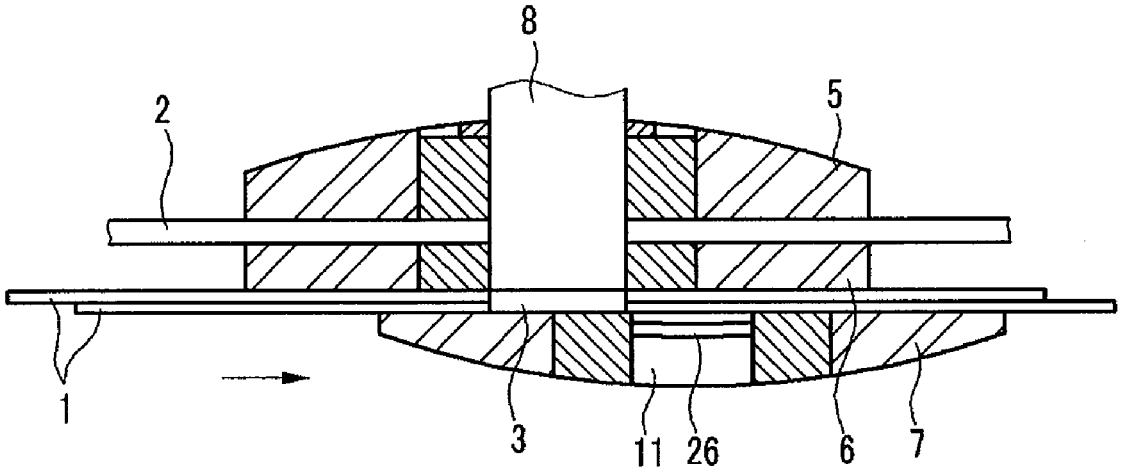
FIG. 2D is a cross-sectional view that shows a process in which excess metal is removed according to an exemplary embodiment of the present invention.

<Description of Reference Numerals Indicating Primary Elements in the Drawings>

| | | | |
|---|---|---|---|
| 1: | metal plate | 2: | metal tape |
| 3: | rivet member | 5: | upper mold |
| 6: | middle mold | 7: | lower mold |
| 8: | punch | 9: | first guide pathway |
| 10: | second guide pathway | 11: | metal removing pathway |
| 12: | power supply | 13: | first electrode |
| 14: | second electrode | 15: | third electrode |
| 16: | heating unit | 17: | high frequency inducing coil |
| 18: | first laser source | 19: | second laser source |
| 20: | metal tape transfer unit | 21: | clamping mold |
| 23: | metal tape supply roller | 24: | metal tape |
| 25: | metal tape withdrawal roller | 26: | excess metal |
| 28: | robot upper arm | 29: | robot lower arm |
| 30: | connecting portion | 31: | clamping unit |

-continued

<Description of Reference Numerals Indicating Primary Elements in the Drawings>

| | | | |
|---|---|---|---|
| 32: | bonding unit | 33: | lower mold transfer unit |
| 34: | transfer roller | 35: | supporter |
| 36: | excess metal collecting home | 37: | robot |
| 38: | coil spring | 39: | clamping unit piston |
| 40: | bonding unit cylinder | | |

DETAILED DESCRIPTION OF THE EMBODIMENTS

An exemplary embodiment of the present invention will hereinafter be described in detail with reference to the accompanying drawings.

Figure 8:
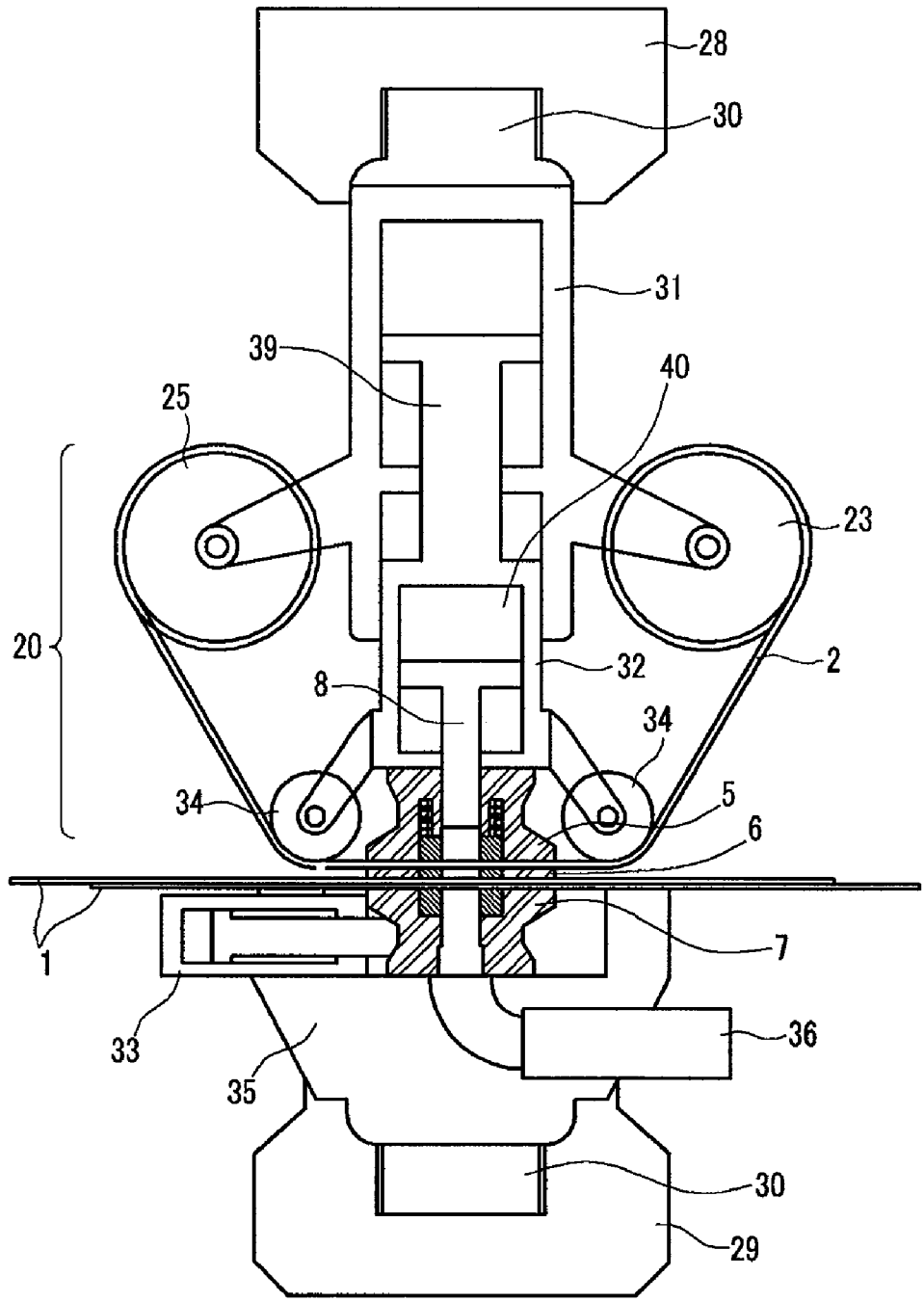
FIG. 8 is a cross-sectional view of an exemplary bonding apparatus of metal plates according to an embodiment of the present invention.

As shown in FIG. 1 and FIG. 8, an exemplary bonding apparatus of metal plates according to an embodiment of the present invention includes a supporter 35, an upper mold 5, a middle mold 6, a lower mold 7, a heating unit 16, a punch 8, a clamping unit 31, a bonding unit 32, a metal tape transfer unit 20, and a lower mold transfer unit 33.

The supporter 35 supports the bonding apparatus of the metal plates according to the embodiment of the present invention.

A first guide pathway 9 is formed vertically inside the upper mold 5. The first guide pathway 9 guides the punch 8.

The middle mold 6 is disposed under the upper mold 5. A second guide pathway 10 is formed vertically inside the middle mold 6. The second guide pathway 10 guides the punch 8.

Both the upper mold 5 and the middle mold 6 clamp a metal tape 2 for making a rivet member 3.

A clamping mold 21 for clamping the metal tape 2 is disposed on an interior circumference of the upper mold 5.

In addition, an elastic member for applying an elastic force downwardly to the clamping mold 21 is interposed between the upper mold 5 and the clamping mold 21.

The elastic member may be a coil spring 38.

The lower mold 7 is disposed under the middle mold 6. A metal removing pathway 11 is formed vertically inside the lower mold 7. The metal removing pathway 11, as shown in FIG. 8, leads to an excess metal collecting home 36. Excess metal 26 is pushed to the excess metal gathering home 36 through the metal removing pathway 11 after the metal plates 1 are bonded.

Both the middle mold 6 and the lower mold 7 clamp the overlapped metal plates 1.

The first and second guide pathways 9 and 10 and the metal removing pathway 11 have cylindrical shapes with the same central axis.

As shown in FIG. 1, radius r1 of the first guide pathway 9 is the same as radius r2 of the second guide pathway 10 so as to guide the punch 8. However, radius r3 of the metal removing pathway 11 is smaller than radius r2 of the second guide pathway 10 so as to bond the metal plates 1 with the rivet member 3.

Figure 7:
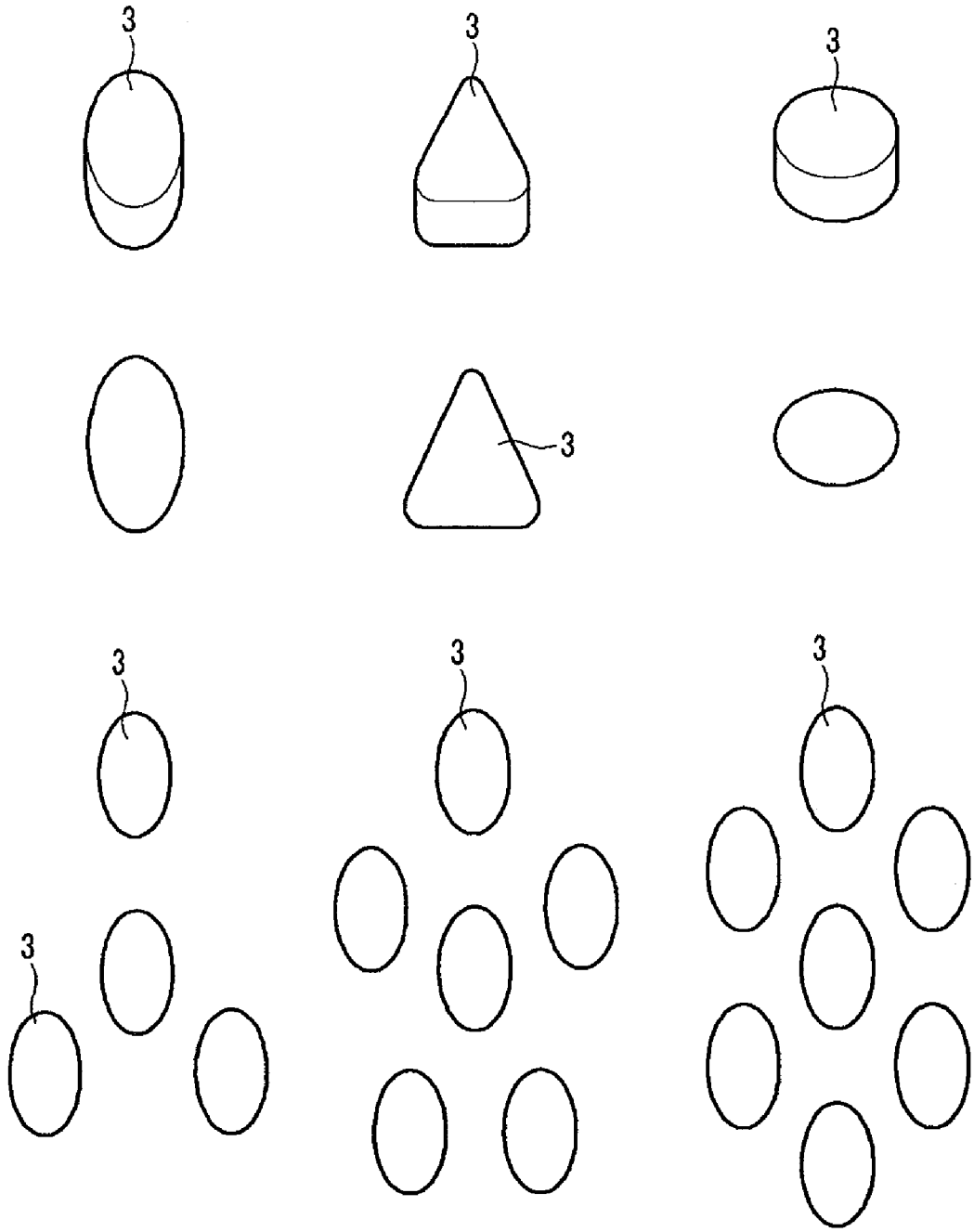
FIG. 7 is a schematic diagram showing a shape and an arrangement of a rivet member according to an exemplary embodiment of the present invention.

Meanwhile, as shown in FIG. 7, the first and second guide pathways 9 and 10 and the metal removing pathway 11 may have triangular-prism shapes. In this case, the bonded metal plates 1 are restricted in rotation since a cross-section of the punched rivet member 3 is triangular. In addition, pluralities of the first and second guide pathways 9 and 10 and the metal removing pathway 11 may be formed and the metal plates 1 may be bonded with the rivet members 3 at multiple bonding positions. The bonded metal plates 1 are restricted in rotation by means of such disposition of the bonding positions.

Here, the cross-section of the rivet member 3 has a circular shape or a triangular shape, but is not limited to such shapes. It is understood that a person of an ordinary skill in the art can arbitrarily select the cross-sectional shape of the rivet member 3.

The heating unit 16 heats the metal plates 1 and the metal tape 2 to the temperature where a plastic flow occurs.

Figure 3:
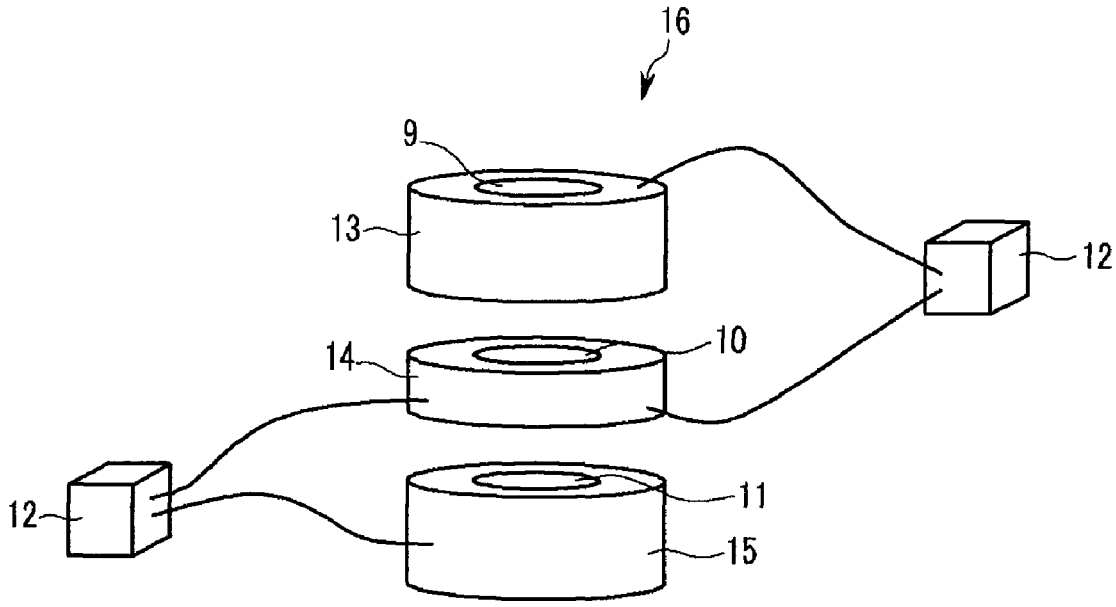
FIG. 3 is a schematic diagram of a heating unit according to an exemplary embodiment of the present invention.

The heating unit 16, as shown in FIG. 3, includes three electrodes 13, 14, and 15. A first electrode 13 is disposed over a second electrode 14 connected to a power supply 12. The metal tape 2 disposed between the first and second electrodes 13 and 14 is quickly heated when an electrical current is applied between the first and second electrodes 13 and 14. In addition, a third electrode 15 connected to the power supply 12 is disposed under the second electrode 14. The metal plates disposed between the second and third electrodes 14 and 15 are quickly heated when an electrical current is applied between the second and third electrodes 14 and 15.

Cross-sections of the first, second, and third electrodes 13, 14, and 15 are circular in shape with the same central axis. In addition, the metal plates 1 and the metal tape 2 have high electrical resistance so that heat is generated therein when the electrical current is applied thereto.

Figure 4:
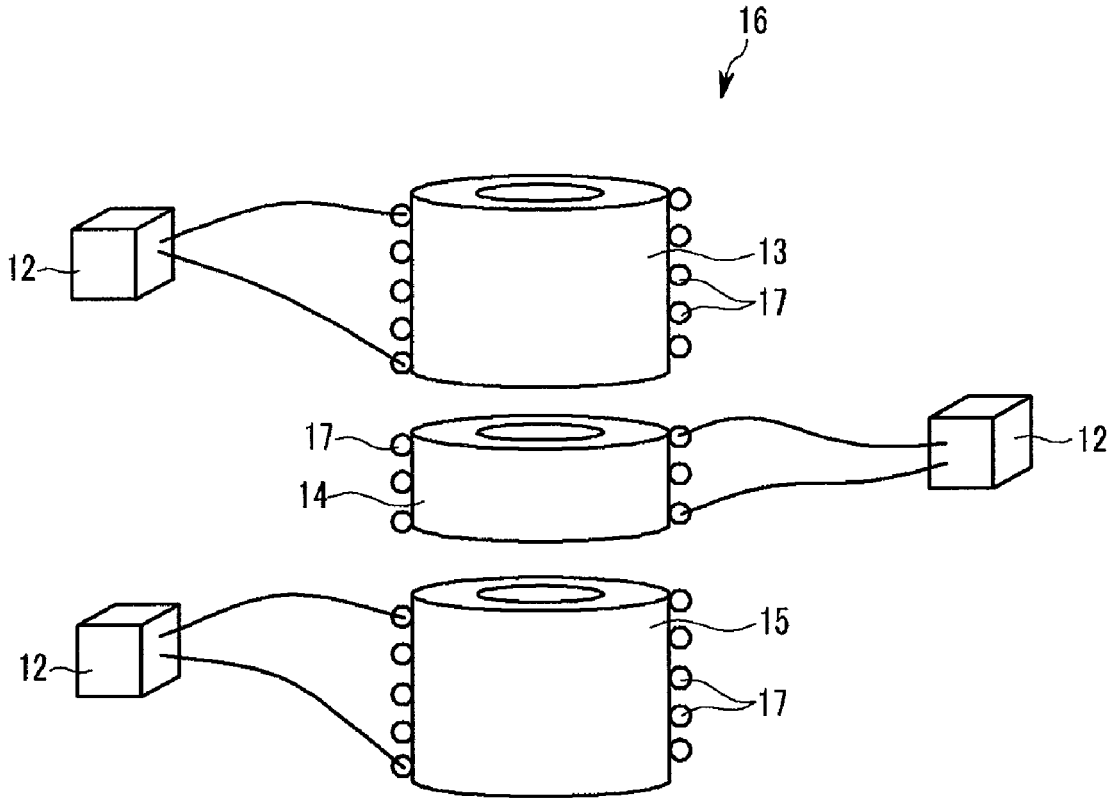
FIG. 4 is a schematic diagram of another heating unit according to an exemplary embodiment of the present invention.

Another heating unit 16 according to an embodiment of the present invention, as shown in FIG. 4, includes the first, second, and third electrodes 13, 14, and 15 wound with a high frequency inducing coil 17. The first, second, and third electrodes 13, 14, and 15 heat the metal plates 1 and the metal tape 2 quickly. That is, the high frequency inducing coil 17 connected to the power supply 12 winds around the first and second electrodes 13 and 14. Therefore, the metal tape 2 disposed between the upper mold 5 and the middle mold 6 is quickly heated by an induced current. In addition, the high frequency inducing coil 17 connected to the power supply 12 winds around the second and third electrodes 14 and 15. Therefore, the metal plates 1 disposed between the middle mold 6 and the lower mold 7 are quickly heated by an induced current.

Figure 5:
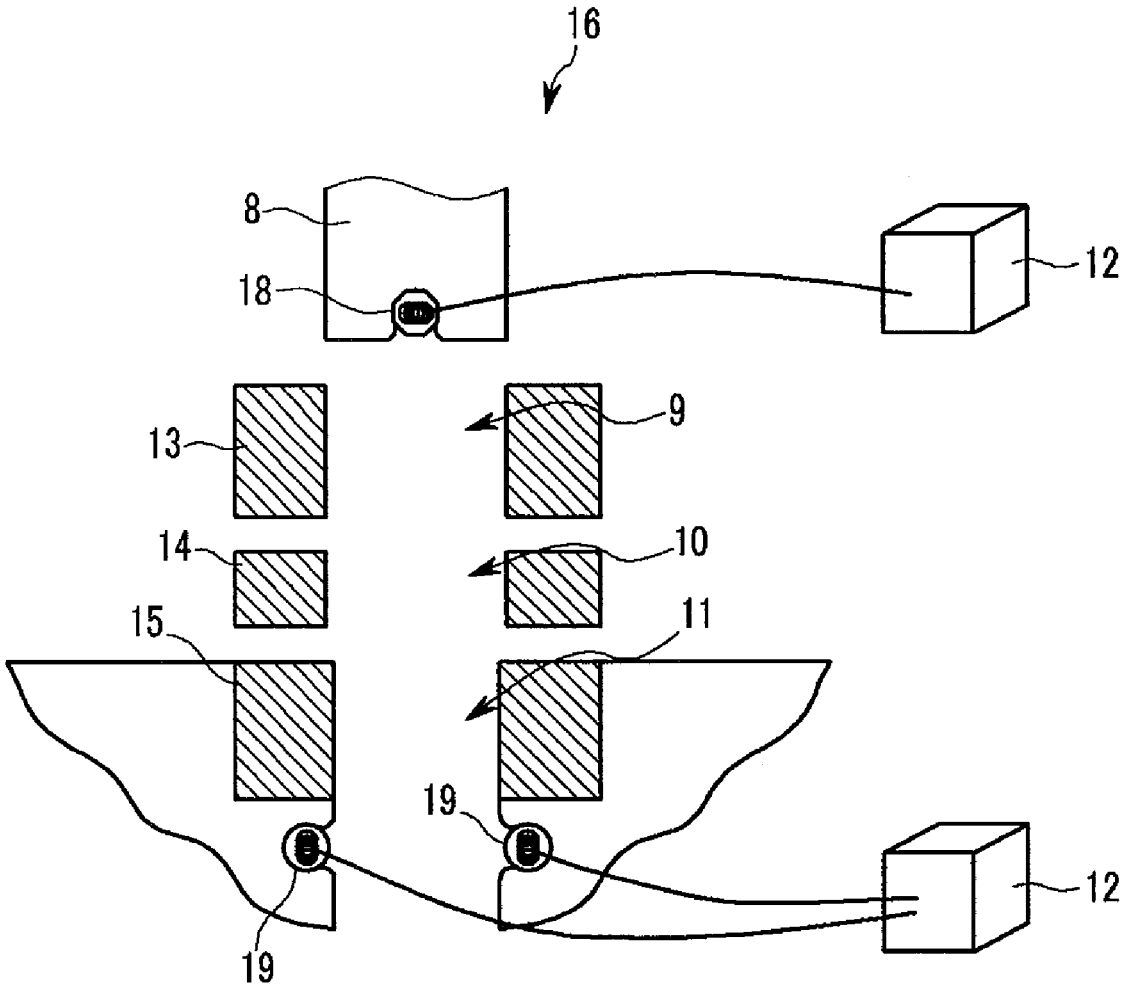
FIG. 5 is a schematic diagram of the other heating unit according to an exemplary embodiment of the present invention.

The other heating unit 16 according to an embodiment of the present invention, as shown in FIG. 5, includes a first laser source 18 mounted on a lower side of the punch 8 and a second laser source 19 mounted on an interior circumference of the lower mold 7. The first and second laser sources 18 and 19 heat the metal tape 2 and the metal plates 1. That is, the metal tape 2 disposed between the upper mold 5 and the middle mold 6 is quickly heated by the first laser source 18 mounted on the lower side of the punch 8, and the metal plates 1 disposed between the middle mold 6 and the lower mold 7 are quickly heated by the second laser source 19 mounted on the interior circumference of the lower mold 7.

The heating unit 16 is not limited to the disclosed embodiments, but, on the contrary, is intended to cover various modifications and equivalent arrangements included within the spirit and scope of the appended claims.

That is, any heating unit 16 that heats the metal tape 2 and the metal plates 1 in the molds so as to bond the metal plates 1 through plastic flow may be applied to the present invention. In addition, the heating unit 16 heats the metal tape 2 and the metal plates 1 to the temperature where the metal plates 1 and the metal tape 2 undergo the plastic flow, but do not melt.

The punch 8 is connected to the bonding unit 32 and transmits a pressure from the bonding unit 32. The punch 8 applies a bonding load to the metal plates 1. The punch 8 moves downwardly along the first guide pathway 9, and makes the rivet member 3 by punching the metal tape 2.

After that, the punch 8 moves further downwardly along the second guide pathway 9, and press-fits the rivet member 3 to the metal plates 1. In this case, the punch 8 moves to and stops on an upper surface of the overlapped metal plates 1 so as to press-fit the rivet member 3 to the metal plates 1 since the radius r3 of the metal removing pathway 11 is smaller than the radius r2 of the second guide pathway 10.

The cross-sectional shape of the punch 8 is the same as that of the first and second guide pathways 9 and 10.

The clamping unit 31 is coupled with an upper side of the upper mold 5. The clamping unit 31 applies a clamping load for clamping the metal plates 1 to the upper mold 5. A hydraulic pressure cylinder may be used as the clamping unit 31.

The bonding unit 32 is coupled with an upper side of the punch 8, and applies the bonding load to the punch 8. A hydraulic pressure cylinder may be used as the bonding unit 32. In addition, a bonding unit cylinder 40 of the bonding unit 32 is formed at a clamping unit piston 39 of the clamping unit 31. Therefore, when a hydraulic pressure is applied to the clamping unit 31 and the clamping unit piston 39 moves downwardly, the bonding unit cylinder 40 moves downwardly together with the clamping unit piston 39 and applies the bonding load to the punch 8. In addition, the size of a bonding apparatus of metal plates may be reduced by such structure.

The metal tape transfer unit 20 includes transfer rollers 34, a metal tape supply roller 23, and a metal tape withdrawal roller 25.

The transfer rollers 34 are mounted on both sides of the upper mold 5. The transfer rollers 34 transfer the metal tape 2.

The metal tape supply roller 23 is mounted on one side of the clamping unit 31. The metal tape 2 is wound onto the metal tape supply roller 23. The metal tape supply roller 23 supplies the metal tape 2 to a bonding apparatus of metal plates.

The metal tape withdrawal roller 25 is mounted on the other side of the clamping unit 31. The metal tape 2, after being punched, is withdrawn to the metal tape withdrawal roller 25.

After the metal tape 2 wound onto the metal tape supply roller 23 is unwound and supplied to a bonding apparatus of metal plates by the transfer rollers 34, the punch 8 moves downwardly so as to punch the metal tape 2 and bond the metal plates 1. After that, while the punch 8, the bonding unit 32, and the clamping unit 31 return to their original positions, the metal tape 2 is wound onto the metal tape withdrawal roller 25. Therefore, the metal tape 2 is continuously supplied to a bonding apparatus of metal plates. In addition, when the metal tape 2 is used up, a new metal tape 2 is replaced on the metal tape supply roller 23. An impact load or a repetitive load may be applied to the punch 8 by a hydraulic pressure system or a pneumatic pressure system, and a person of ordinary skill in the art can arbitrarily choose a load type and a pressure applying system within the scope of the present invention.

The lower mold transfer unit 33 is coupled with the lower mold 7. The lower mold transfer unit 33 moves the lower mold 7 in a horizontal direction. A hydraulic pressure cylinder may be used as the lower mold transfer unit 33.

Figure 9:
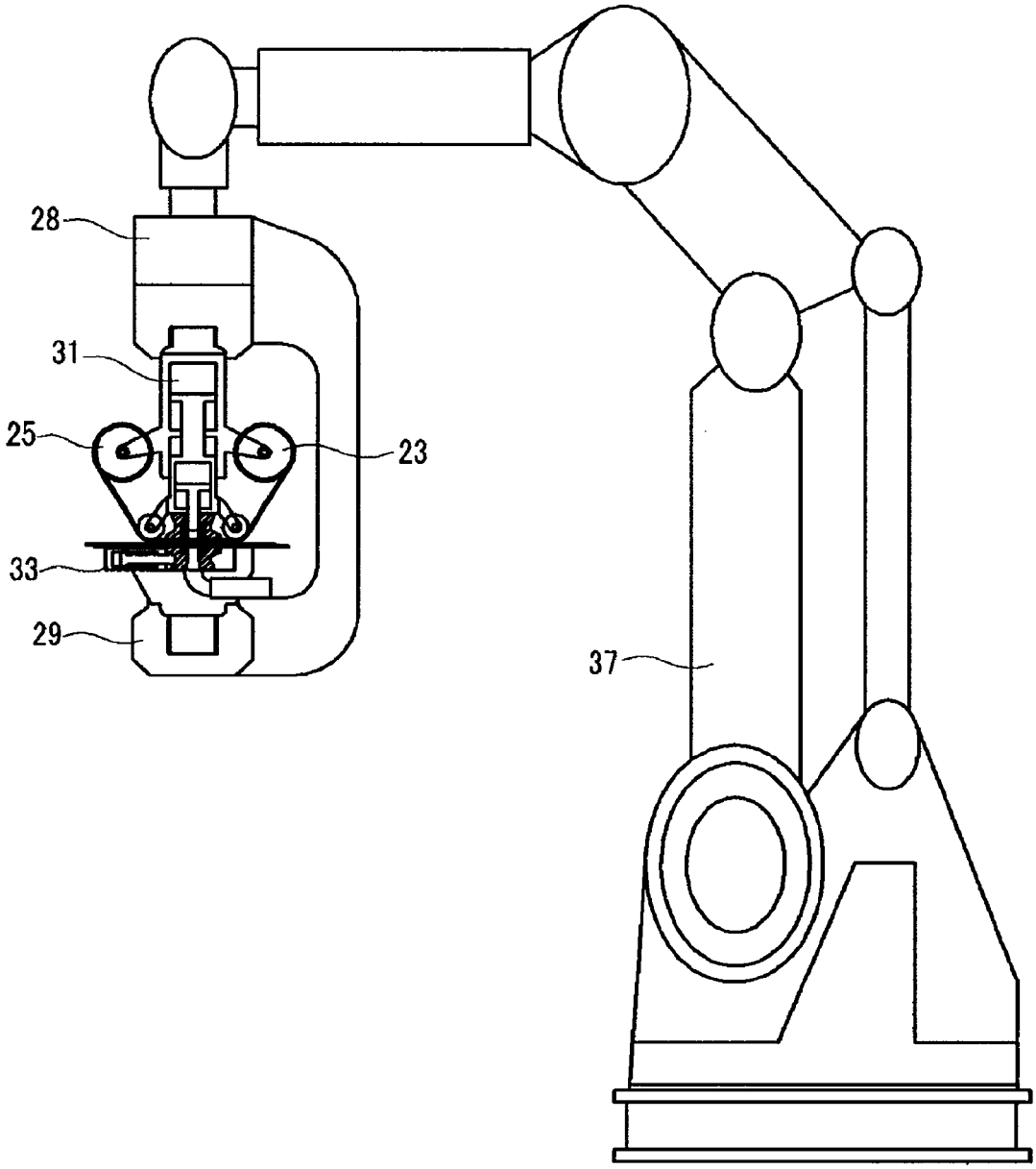
FIG. 9 is a schematic diagram showing that an exemplary bonding apparatus of metal plates according to an embodiment of the present invention is mounted on a robot.

As shown in FIG. 9, an exemplary bonding apparatus of metal plates according to an embodiment of the present invention may be mounted on a robot 37 that is used for spot welding. In this case, a bonding apparatus of metal plates further includes connecting portions 30 connected to a robot upper arm 28 and robot lower arm 29. Therefore, a bonding apparatus of metal plates is mounted on the robot 37 used for spot welding, and the first, second, and third electrodes 13, 14, and 15 are connected to the power supply 12. After that, the robot 37 including the hydraulic pressure system or the pneumatic pressure system for supplying the clamping load and bonding load is moved to the bonding position, and the metal plates 1 are bonded.

Meanwhile, the metal tape 2 and the metal plates 1 are made with the same material so that the metal plates 1 are easily bonded.

Hereinafter, referring to FIG. 2 and FIG. 6, an exemplary bonding method of metal plates according to an embodiment of the present invention will be described in detail.

As shown in FIG. 2, after the bonding position of the overlapped metal plates 1 is located above the metal removing pathway 11 of the lower mold 7, the center of the second guide pathway 10 is met with the center of the bonding position. After that, the metal plates 1 are clamped by the middle mold 6 and the lower mold 7. In addition, the metal tape 2 is clamped by the upper mold 5 and the middle mold 6.

After that, the heating unit 16 receives power from the power supply 12 and heats the metal tape 2 and the metal plates 1.

After that, the punch 8 moves downwardly through the first guide pathway 9, and punches the metal tape 2 so as to make the rivet member 3.

After that, the punch 8 moves further downwardly through the second guide pathway 10, and press-fits the rivet member 3 into the overlapped metal plates 1. In this case, downward movements of the rivet member 3 and the metal plates 1 is restricted by an upper side of the metal removing pathway 11 since the radius r3 of the metal removing pathway 11 is smaller than the radius r2 of the second guide pathway 10. Thus, the rivet member 3 and the metal plates 1 are bonded through the plastic flow.

Figure 6:
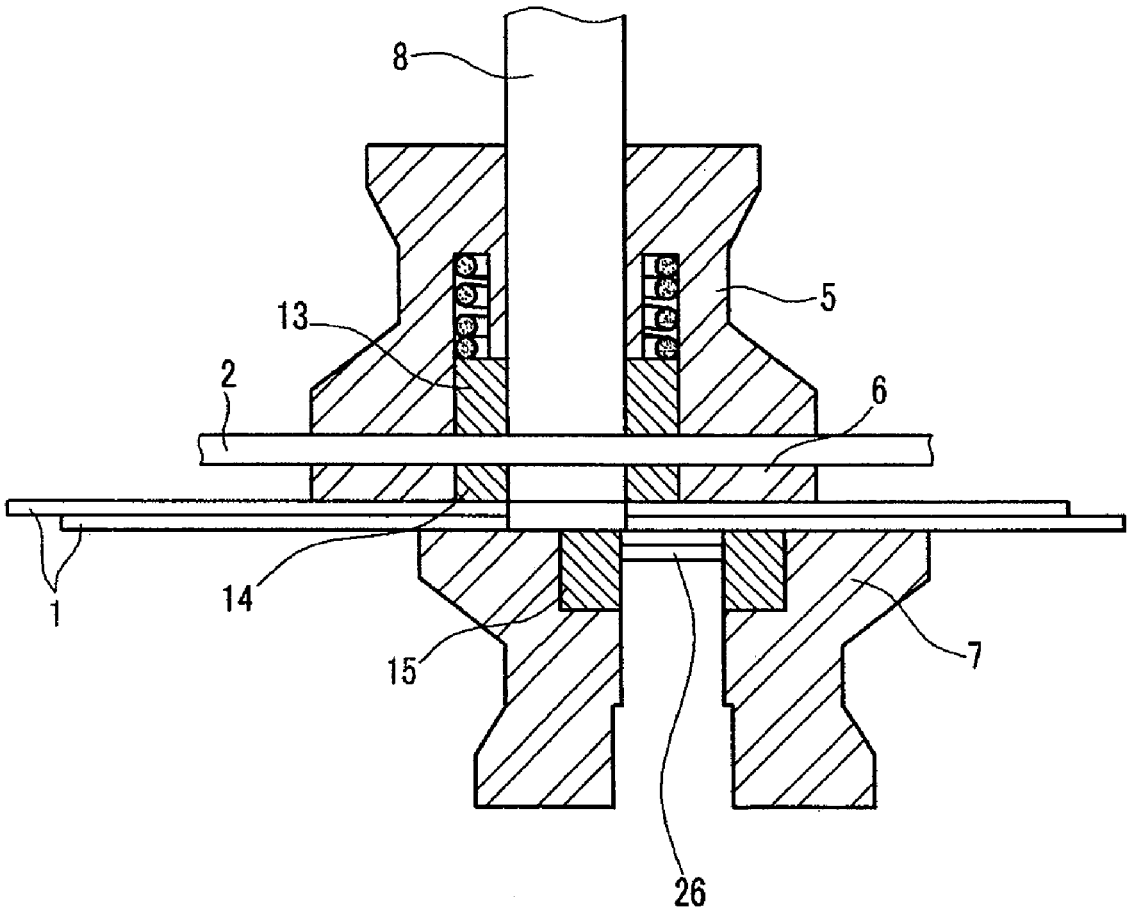
FIG. 6 is a cross-sectional view that shows a process in which excess metal is removed when a lower mold is moved in a horizontal direction according to an exemplary embodiment of the present invention.

Meanwhile, as shown in FIG. 6, excess metal 26 that is pushed downwardly during a bonding process is removed when the lower mold 7 is moved horizontally by the lower mold transfer unit 33. In this case, the lower mold 7 removes the excess metal 26 and simultaneously shaves lower sides of the bonding position of the metal plates 1 and the rivet member 3. In addition, the excess metal 26 is gathered in the excess metal gathering home 36 through the metal removing pathway 11.

A body of a vehicle has been previously welded mainly according to a spot welding method. According to the method, the metal plates mainly used as the body of the vehicle have high electrical resistances, and thus melt well when a high electrical current is applied thereto. On the contrary, light metal plates having low electrical resistances do not melt well when a high electrical current is applied thereto. However, according to the present invention, the heated light metal plates are bonded through the plastic flow, and thus an arc may not occur. In addition, according to the present invention, the metal plates are bonded by press-fitting the rivet member into the heated metal plates. Thus, the metal plates may be bonded with a small bonding load but with strong bonding strength.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A bonding apparatus of metal plates, comprising:

metal plates that are overlapped each other;

a metal tape used for bonding the overlapped metal plates, and material thereof being the same as material of the metal plates;

a metal tape transfer unit for supplying and withdrawing the metal tape;

a rivet member punched from the metal tape and heated;

an upper mold for clamping the metal tape by an elastic force of a coil spring that is mounted on an upper portion thereof, the upper mold guiding a punch and used as a first electrode;

a middle mold for clamping the overlapped metal plates and punching the metal tape in order to make the rivet member, the middle mold guiding the rivet member and the punch, and used as a second electrode;

a lower mold for supporting the overlapped metal plates, the lower mold being used as an extrusion die for extruding the metal plates by the rivet member, a shaving mold for shaving excess metal during extrusion, and a third electrode; and the punch for making the rivet member by punching the metal tape, the punch press-fitting the rivet member to the overlapped metal plates by applying a load to the rivet member.

2. The apparatus of claim 1, wherein cross-sections of the first and second guide pathways and the metal removing pathway are circular or triangular, by which rotation of the metal plates is restricted, according to a cross-sectional shape of the rivet member.

3. The apparatus of claim 2, wherein at least one of the first and second guide pathways, the metal removing pathway, and the punch is used so as to restrict the rotation of the metal plates.

4. A bonding apparatus of metal plates, comprising:

an upper mold having a first guide pathway formed vertically inside thereof;

a middle mold having a second guide pathway formed vertically inside thereof, the middle mold being disposed under the upper mold;

a lower mold having a metal removing pathway formed vertically inside thereof, the lower mold being disposed under the middle mold;

a heating unit for heating the metal plates and a metal tape;

a punch for applying a bonding load to the metal plates;

a clamping unit that applies a clamping load for clamping the metal plates to the upper mold a bonding unit that applies the bonding load for bonding the metal plates to the punch; and a lower mold transfer unit that moves the lower mold in a horizontal direction.

5. The bonding apparatus of claim 4, wherein both the upper and middle molds clamp the metal tape that is used for a rivet member, and both the middle and lower molds clamp the metal plates.

6. The bonding apparatus of claim 5, wherein material of the metal tape is the same as material of the metal plates.

7. The bonding apparatus of claim 5, further comprising a metal tape transfer unit that moves the metal tape in a horizontal direction.

8. The bonding apparatus of claim 7, wherein the metal tape transfer unit comprises:

transfer rollers disposed on both sides of the upper mold;

a metal tape supply roller disposed on one side of the clamping unit, the metal tape being wound thereon; and a metal tape withdrawal roller disposed on the other side of the clamping unit, the metal tape being withdrawn thereto after being punched.

9. The bonding apparatus of claim 4, further comprising a clamping mold for clamping the metal tape, wherein the clamping mold is disposed on an interior circumference of the upper mold.

10. The bonding apparatus of claim 9, wherein an elastic member that applies an elastic force downwardly to the clamping mold is interposed between the upper mold and the clamping mold.

11. The bonding apparatus of claim 10, wherein the elastic member is a coil spring.

12. The bonding apparatus of claim 9, wherein the heating unit comprises:

a first electrode formed on an interior circumference of the clamping mold;

a second electrode formed on an interior circumference of the middle mold; and a third electrode formed on an interior circumference of the lower mold.

13. The bonding apparatus of claim 12, wherein heat is generated in the metal plates and the metal tape when an electrical current is applied thereto since electrical resistance thereof is high.

14. The bonding apparatus of claim 12, wherein the first, second, and third electrodes are respectively wound by a high frequency inducing coil.

15. The bonding apparatus of claim 4, wherein the heating unit comprises:

a first laser source for heating the metal tape, the first laser source mounted on a lower side of the punch; and a second laser source for heating the metal plates, the second laser source mounted on an interior circumference of the lower mold.

16. The bonding apparatus of claim 4, wherein the first and second guide pathways have the same radius.

17. The bonding apparatus of claim 16, wherein the radius of the metal removing pathway is smaller than the radius of the second guide pathway.

18. The bonding apparatus of claim 4, wherein the first and second guide pathways and the metal removing pathway have cylindrical shapes.

19. The bonding apparatus of claim 4, wherein the first and second guide pathways and the metal removing pathway have triangular-prism shapes.

20. The bonding apparatus of claim 4, wherein a bonding unit cylinder of the bonding unit is formed at a clamping unit piston of the clamping unit.

21. A bonding method of metal plates, comprising:

clamping the overlapped metal plates with a lower mold and a middle mold;

disposing a metal tape over the overlapped metal plates by the middle mold and an upper mold;

heating the overlapped metal plates and the metal tape with a heating unit;

making a rivet member by punching the metal tape; and press-fitting the rivet member into the overlapped metal plates with a punch; and removing excess metal that is pushed out during press-fitting, wherein the excess metal is removed and the metal plates are shaved by moving the lower mold in a horizontal direction, coincidentally.

22. The bonding method of claim 21, wherein a first guide pathway is formed vertically in the upper mold, a second guide pathway is formed vertically in the middle mold, and a metal removing pathway is formed vertically in the lower mold.

23. The bonding method of claim 21, wherein the first and second guide pathways have the same radius.

24. The bonding method of claim 21, wherein the radius of the metal removing pathway is smaller than the radius of the second guide pathway.

* * * * *